US012767296B2

(12) United States Patent
Streitlien

(10) Patent No.: US 12,767,296 B2
(45) Date of Patent: Oct. 20, 2026

(54) SUBMERSIBLE GLIDER WITH RING WING

(71) Applicant: Apeiron Labs Inc., Cambridge, MA (US)

(72) Inventor: Knut Streitlien, Jamaica Plain, MA (US)

(73) Assignee: Apeiron Labs Inc., Cambridge, MA (US)

( * ) Notice: Subject to any disclaimer, the term of this patent is extended or adjusted under 35 U.S.C. 154(b) by 473 days.

(21) Appl. No.: 18/489,336

(22) Filed: Oct. 18, 2023

(65) Prior Publication Data

US 2025/0128800 A1 Apr. 24, 2025

(51) Int. Cl.
*B63G 8/20* (2006.01)
*B63G 8/24* (2006.01)

(52) U.S. Cl.
CPC *B63G 8/20* (2013.01); *B63G 8/24* (2013.01)

(58) Field of Classification Search
CPC ..... B63G 8/20; B63G 8/24
See application file for complete search history.

(56) References Cited

U.S. PATENT DOCUMENTS 803,174 A * 10/1905 Lake ..... B63G 8/24 114/333
5,666,900 A * 9/1997 Carroll, III ..... B63G 8/30 114/238
7,028,631 B2 * 4/2006 August ..... B63G 8/14 114/345
9,227,709 B1 * 1/2016 Schill ..... F16C 17/047
2014/0261138 A1 * 9/2014 Rikoski ..... B63B 35/40 114/312

OTHER PUBLICATIONS

De Barros, E. A., and João Lucas Dozzi Dantas. "Effect of a propeller duct on AUV maneuverability." Ocean Engineering 42 (2012): 61-70.

Fletcher, Herman S. Experimental investigation of lift, drag, and pitching moment of five annular airfoils. No. NACA-TN-4117. 1957.

Werle, Michael J. "Aerodynamic loads and moments on axisymmetric ring-wing ducts." AIAA Journal 52.10 (2014): 2359-2364.

* cited by examiner

*Primary Examiner* — Stephen P Avila
(74) *Attorney, Agent, or Firm* — Foley & Lardner LLP

(57) ABSTRACT

A submersible glider with a ring wing is provided. The glider can operate in an aqueous medium. The glider can include a fuselage in a shape of a body of revolution. The glider can include a ring wing lifting surface coupled to a stern of the fuselage. The glider can include a buoyancy engine disposed within the fuselage, the buoyancy engine configured to adjust a buoyancy and a center-of-gravity of the glider in the aqueous medium, to propel the glider through the aqueous medium by leveraging lift from the ring wing lifting surface.

20 Claims, 11 Drawing Sheets

SUBMERSIBLE GLIDER WITH RING WING

BACKGROUND

A vehicle can be submerged in an aqueous medium, such as the sea. The vehicle can float or sink in the aqueous medium. However, it can be challenging to sufficiently propel the vehicle in a horizontal direction underwater without utilizing excessive energy resources or providing a vehicle with excessive dimensions.

SUMMARY

Technical solutions described herein are directed to a glider with a ring wing that can be submerged in an aqueous medium. The glider (or submersible glider) with the ring wing can have a streamlined, cylindrical shape that can allow the glider to be stored and deployed from a launch container (e.g., a launch container in an aircraft or marine vessel), while the ring wing serves as a lifting surface that can propel the glider in at least a partially horizontal direction underwater.

At least one aspect of the present disclosure is directed to a glider to operate in an aqueous medium. The glider can include a fuselage in the shape of a body of revolution. The glider can include a ring wing lifting surface (e.g., surface of a partial or full structure of a ring wing) coupled to a stern of the fuselage. The glider can include a buoyancy engine disposed within the fuselage. The buoyancy engine can be configured to adjust a buoyancy and a center-of-gravity of the glider in the aqueous medium to propel (e.g., guide, move, maneuver, direct, drive, steer) the glider through the aqueous medium by leveraging lift from the ring wing lifting surface.

The ring wing lifting surface coupled to the stern can be configured to pivot or tilt the ring wing lifting surface along a first axis (e.g., vertical axis) to steer the glider through the aqueous medium. The ring wing lifting surface coupled to the stern can be configured to pivot the ring wing lifting surface along a second axis (e.g., horizontal axis), which may be perpendicular to the first axis, to adjust an ascent or descent of the glider through the aqueous medium.

The glider can include an actuator. The actuator can be coupled to a portion of the stern of the fuselage, the actuator configured to extend the ring wing lifting surface between a first position relative to the stern of the fuselage and a second position.

The glider can include a pressure switch. The pressure switch can be configured to detect an increase in pressure subsequent to the glider being launched in the aqueous medium. The pressure switch can unlock a spring, responsive to the increase in the pressure greater than a threshold, to cause the spring to extend the ring wing lifting surface between the first position and the second position.

A ratio of a diameter of the ring wing lifting surface to a length of the ring wing lifting surface can be greater than or equal to 1. The buoyancy engine can include a pump configured to capture or release a fluid from a compartment within the fuselage to adjust the buoyancy of the glider. The glider can include one or more sensors configured to detect one or more characteristics of the aqueous medium or effects of an external stimuli on the aqueous medium.

The glider can include a power source to deliver power to the buoyancy engine to adjust the buoyancy of the glider in the aqueous medium. The ring wing lifting surface can include an airfoil shaped element. The glider may lack a wing separate from the ring wing lifting surface, and may lack a propeller. The glider can be loaded into a tube of a launch container.

The glider can include a data processing system including one or more processors, coupled with memory, to receive a glide angle of the glider. The data processing system can receive a velocity of the glider. The data processing system can determine, based on the glide angle and the velocity, a control command to control a position of the ring wing lifting surface to increase the velocity of the glider. The data processing system can operate an actuator to rotate the ring wing lifting surface to the position based on the control command.

At least one aspect of the present disclosure is directed to a system. The system can include a launch container, disposed on a marine vessel (or aircraft), to store at least one glider. Each of the at least one glider can include a fuselage in the shape of a body of revolution. Each of the at least one glider can include a ring wing lifting surface coupled to a stern of the fuselage. Each of the at least one glider can include a buoyancy engine disposed within the fuselage. The buoyancy engine can be configured to adjust a buoyancy and a center-of-gravity of the fuselage in an aqueous medium to propel the fuselage through the aqueous medium by leveraging lift from the ring wing lifting surface. The system can include one or more processors, coupled with memory, to deploy the at least one glider from the launch container into the aqueous medium.

Each of the at least one glider can include an actuator coupled to a portion of the stern of the fuselage, the actuator configured to extend the ring wing lifting surface between a first position relative to the stern of the fuselage and a second position responsive to deployment from the launch container into the aqueous medium.

Each of the at least one glider can include a pressure switch configured to detect an increase in pressure subsequent to deployment into the aqueous medium from the launch container. The pressure switch can unlock a spring, responsive to the increase in the pressure greater than a threshold, to cause the spring to extend the ring wing lifting surface between the first position and the second position.

Each of the at least one glider can include one or more sensors configured to detect one or more characteristics of the aqueous medium or effects of an external stimuli on the aqueous medium. The launch container can include multiple tubes to store the at least one glider.

At least one aspect of the present disclosure is directed to a method. The method can include deploying a glider in an aqueous medium, the glider comprising a fuselage in the shape of a body of revolution and a ring wing lifting surface coupled to a stern of the fuselage. The method can include adjusting, by a buoyancy engine disposed within the fuselage, a buoyancy and a center-of-gravity of the glider in the aqueous medium to propel the glider through the aqueous medium by leveraging lift from the ring wing lifting surface.

The method can include pivoting the ring wing lifting surface to steer the glider through the aqueous medium.

These and other aspects and implementations are discussed in detail below. The foregoing information and the following detailed description include illustrative examples of various aspects and implementations, and provide an overview or framework for understanding the nature and character of the claimed aspects and implementations. The drawings provide illustration and a further understanding of the various aspects and implementations, and are incorporated in and constitute a part of this specification. The foregoing information and the following detailed description and drawings include illustrative examples and should not be considered as limiting.

BRIEF DESCRIPTION OF THE DRAWINGS

The accompanying drawings are not intended to be drawn to scale. Like reference numbers and designations in the various drawings indicate like elements. For purposes of clarity, not every component may be labeled in every drawing. In the drawings.

DETAILED DESCRIPTION

Figure 1:
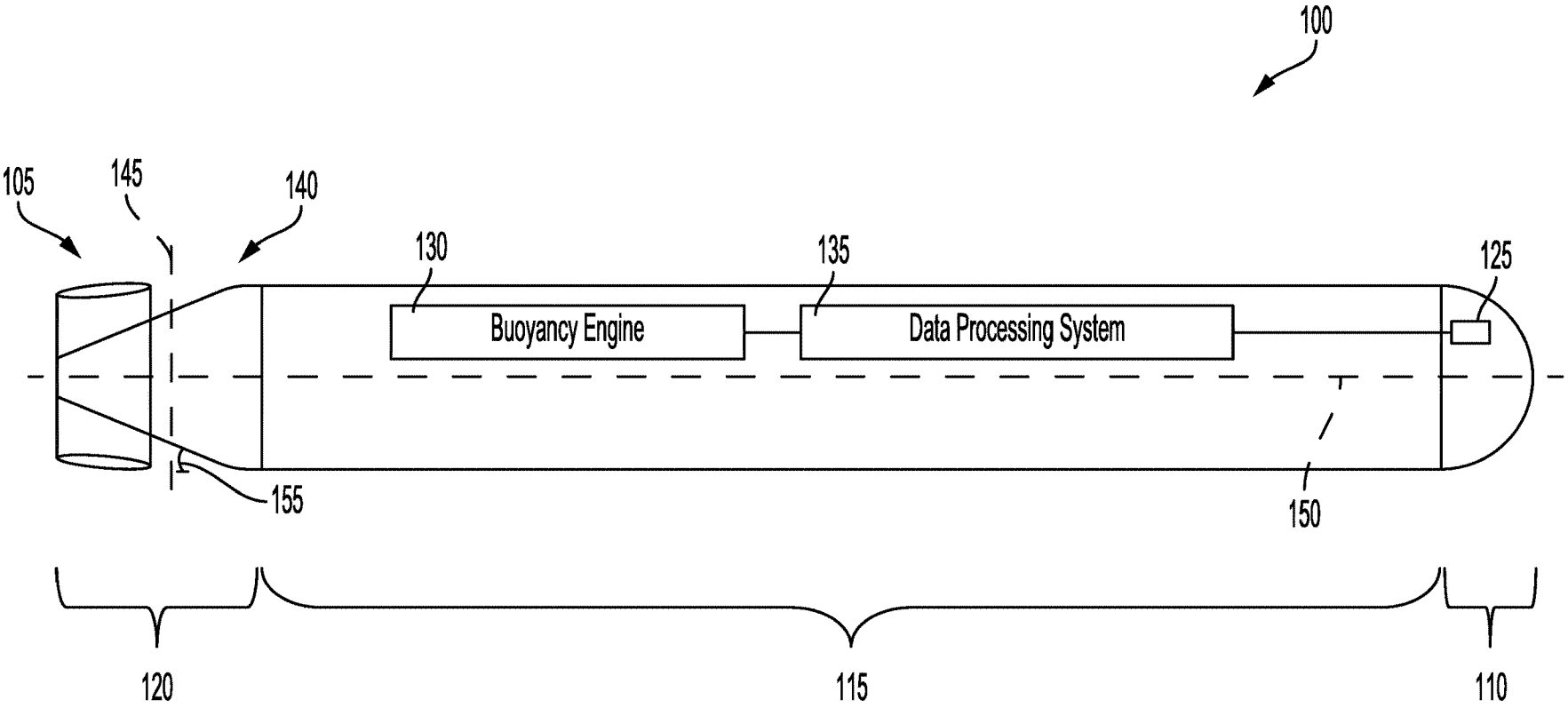
FIG. 1 is an example submersible glider including a ring wing.
Figure 2:
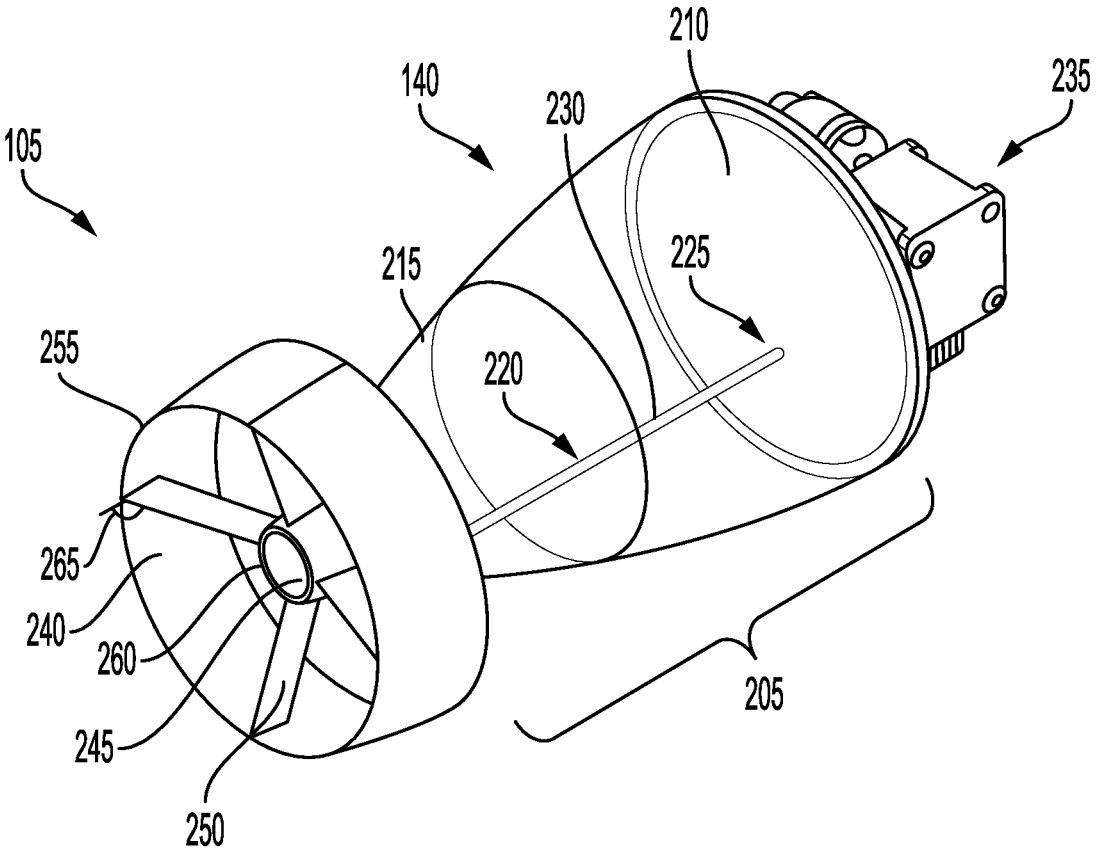
FIG. 2-5 are examples of a ring wing of a submersible glider.
Figure 3:
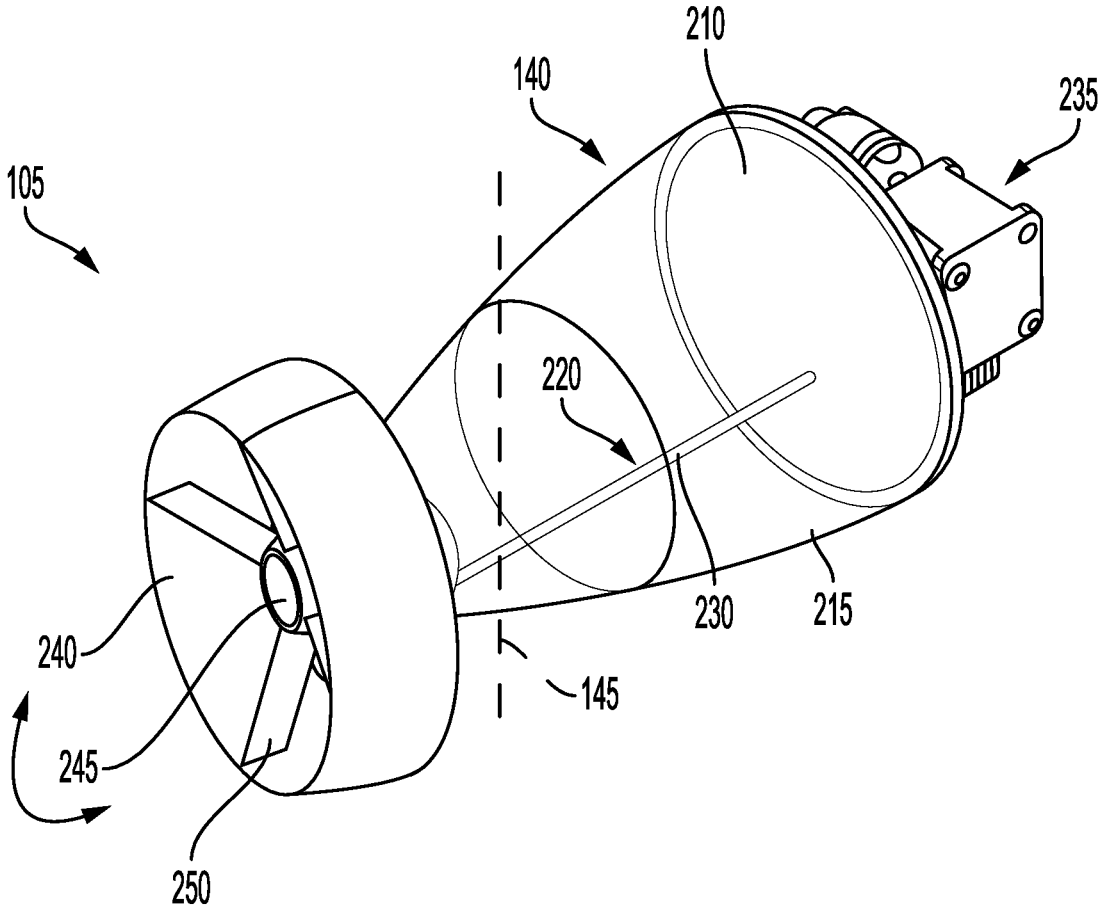
Figure 4:
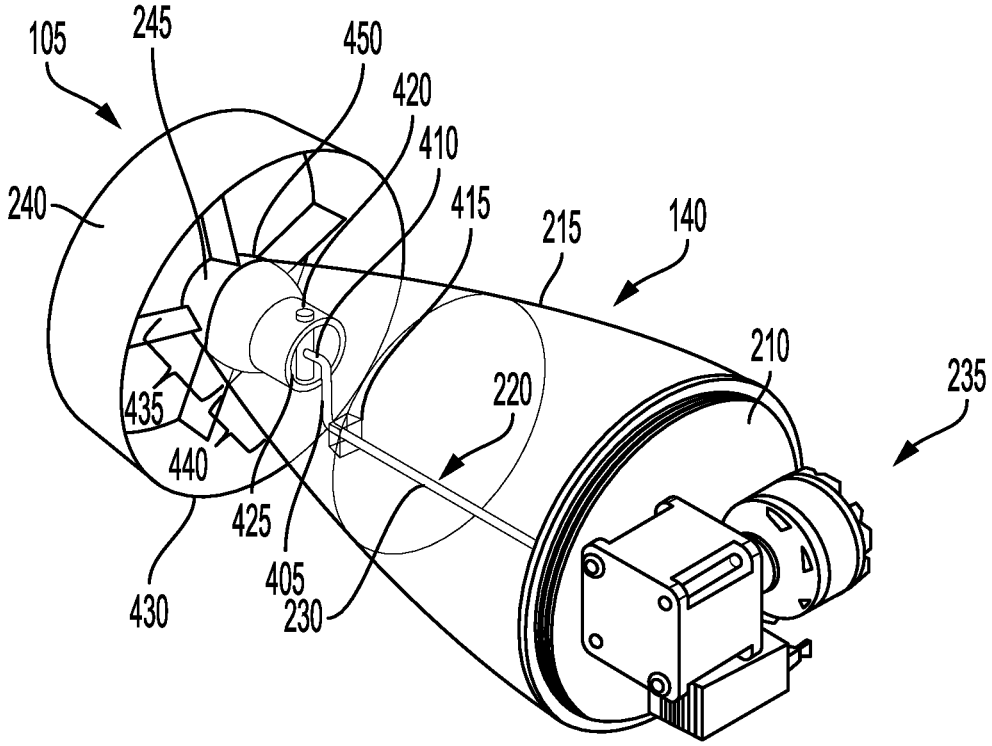
Figure 5:
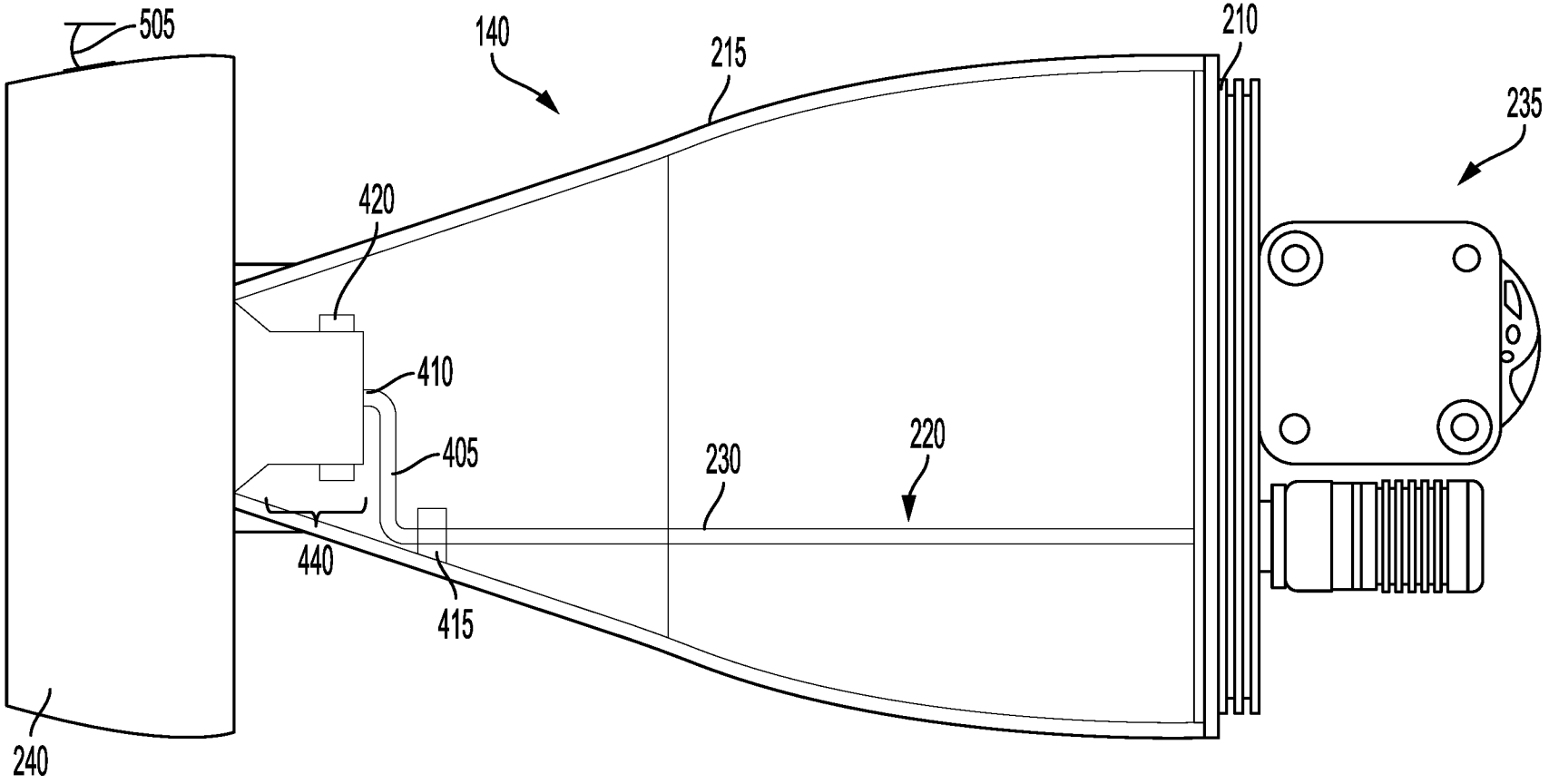

Following below are more detailed descriptions of various concepts related to, and implementations of, methods, apparatuses, and systems of a submersible glider including a ring wing (e.g., lifting surface shaped as a partial or full ring wing structure). The various concepts introduced above and discussed in greater detail below may be implemented in any of numerous ways.

A submersible glider can be a platform that submerges in, and travels through, an aqueous medium. The aqueous medium can be water, oil, or any other liquid. The aqueous medium can be an ocean, a sea, a lake, a flooded area, a canal, or any other body of liquid. The glider can derive its horizontal mobility or gliding propulsion from an imbalance between the buoyancy of the glider and the weight of the glider. This gliding propulsion can result in an energy efficient transit at low speeds, allowing a glider to be deployed for a long duration of time (e.g., weeks, months, quarters, years). Because of the low energy needs to the glider, the glider can make observations of measurements over a large area. The glider can receive its hydrodynamic lift from wings attached to, or integral with, a fuselage of the glider. For example, the wings can extend outwards away from an outer surface of the fuselage from a mid-portion of the fuselage of the glider. The wings can provide a lifting force such that the glider can move at a shallow angle with respect to the horizon.

However, the wings can be large, and can require a significant amount of resources to design, develop, or manufacture. Furthermore, the wings can be fragile, and can easily break or otherwise be damaged during transport of the glider, deployment of the glider, or while the glider travels through the aqueous medium. Furthermore, the wings can complicate the handling or maneuverability of the gliders. This can all make deploying gliders (e.g., in large numbers or otherwise) difficult. Furthermore, because the gliders can include wings that extend outwards from the fuselage of the glider, the glider may not be able to fit in a launch container, launch tube, or launching device that has a cylindrical/compact cavity or loading space. For example, a standardized sonobuoy launch container (SLC), from which systems can be launched, may have a predefined cylindrical shape, or include a tube with a predefined cylindrical shape. Gliders including wings may not be able to fit within the predefined cylindrical shape of the SLC, thus requiring a customization of a launching apparatus to handle the wings of the glider. These drawbacks to gliders with lateral wings can prevent gliders from being utilized in rapid response applications, or applications where a high density of gliders are to be deployed or a wide area is to be covered.

To solve for these, and other technical issues, the technical solutions disclosed herein can include a glider including a ring wing. Instead of, or in addition to, using lateral wings that extend outwards from the fuselage of the glider, the glider can achieve glide performance via the ring wing. The ring wing can help, facilitate or cause the glider to convert a vertical hydrostatic force into horizontal motion. The ring wing can be, form, or otherwise include a cylindrical lifting surface that provides lift for the glider in an aqueous medium to help propel the glider (e.g., when the buoyancy and/or weight distribution of the glider is adjusted in the aqueous medium, to control a heading, direction and/or motion of the glider relative to the aqueous medium). The ring wing can be coupled with, integrated with, or connected with a rear end, tail, aft, or stern of a fuselage of the glider. The ring wing can be, form, or otherwise include a ring shaped lifting surface, that can includes a circular outer radius, that can be slightly less than a radius of (or conformed with) a cylindrical fuselage of the glider such that the glider can fit within the fuselage. In this regard, the glider can be disposed within, fit within, or loaded into a cylindrical launching container or apparatus, such as a SLC. The lift provided by the ring wing can provide glide for the glider (e.g., in the absence of an active/powered propulsion device), while allowing the glider to have dimensions that conform with the envelope of an SLC or other launch container. Because the glider can be disposed within a SLC, the glider can be deployed rapidly from a large number of platforms that utilize the SLC (such as aircraft, fixed wing aircraft, rotary wing aircraft, helicopters, surface ships, submarines, boats, drones, etc.).

Referring now to FIG. 1, among others, a submersible glider 100 including a ring wing 105 is shown. The glider 100 can be a submersible, and can be partially or completely submerge into an aqueous medium. The glider 100 can be deployed in the ocean, in a lake, in a flooded area, a canal, or in any other body of liquid. The glider 100 can include a longitudinal axis 150, a vertical axis 145, and a horizontal axis. The longitudinal axis 150, the vertical axis 145, and the horizontal axis can be perpendicular to each other. The horizontal axis is not shown in FIG. 1, and can be an angle perpendicular to both the vertical axis 145 and the longitudinal axis 150.

The glider 100 can include a front portion 110, a middle portion 115, and a rear portion 120. The front portion 110 can be a nose or leading edge of the glider 100. The front portion 110 can carry a payload. For example, the front portion 110 can store, include, or carry a sensor 125. The front portion 110 can be formed from, or include, plastic, aluminum, steel and/or any metallic or non-metallic material. The sensor 125 can measure various characteristics of the aqueous medium or the surrounding environment. The sensor 125 can measure temperature, pressure, distance, location, speed, acceleration, motion, radiation, sound, vibrations and/or other characteristics or property of the glider and/or the glider's environment (e.g., the aqueous medium, or an object proximate to or in contact with the glider). The front portion 110 can be open to the aqueous medium to allow for the aqueous medium to enter at least a portion of the front portion 110 for the sensor 125 to interact with to make measurements. The sensor 125 can measure characteristics of the aqueous medium itself, or measure characteristics that identify other conditions. The sensor 125 can measure an external stimuli on the aqueous medium. For example, the sensor 125 can measure characteristics that identify another vehicle submerged within the aqueous medium, floating on the aqueous medium, or flying above the aqueous medium. The sensor 125 can measure characteristics that indicate ocean life, sea life, lake life. The sensor 125 can measure characteristics that indicate geologic features or formations, oil, gas, minerals, etc.

The middle portion 115 can be a hull, fuselage, or pressure vessel of the glider 100. The pressure vessel can be formed from, or include, plastic, aluminum, or steel, as non-limiting examples. The middle portion 115 can have a cylindrical shape. The middle portion 115 can have a tubular shape. The middle portion 115 can have a torpedo shape. The middle portion 115 can have a body of revolution shape or a slender body of revolution shape. A body can be slender if/when the ratio between the length and width of the body is 3-4. A body can be slender if the ratio between the length and width of the body is 2.5-4.5. A body can be slender if/when the ratio between the length and width is less than 2.5. A body can be slender if/when the ratio between the length and width can be greater than 2.5. The middle portion 115 can be sealed, and can prevent water from entering a cavity, opening, or space of the middle portion 115. The middle portion 115 can include one or more valves or openings that allow an aqueous medium to enter a compartment, chamber, bladder, or ballast tank of a buoyancy engine 130 or exit the ballast tank.

The middle portion 115 can be sealed or pressurized. The middle portion 115 can be sealed from the front portion 110 or the rear portion 120. The middle portion 115 can be pressurized to 0.9-1.1 atmospheres of pressure. The middle portion 115 can be pressurized to 0.8-1.2 atmospheres of pressure. The middle portion 115 can be less than 0.8 atmospheres of pressure. The middle portion 115 can be pressurized to more than 1.2 atmospheres of pressure.

At least a portion of the buoyancy engine 130 can be disposed within, placed within, fixed within, or installed within the middle portion 115. The buoyancy engine 130 can include a variable buoyancy system. The buoyancy engine 130 can include center-of-gravity control. The buoyancy engine 130 can include one or more pumps, ballast tanks, compressed gas tanks, oil tanks, and/or other components to increase or decrease the weight and buoyancy of the glider 100, and/or to control/change the weight distribution or center-of-gravity of the glider 100. For example, the buoyancy engine 130 can cause at least one ballast tank to fill with an aqueous medium that the glider 100 is disposed within to decrease the buoyancy of the glider 100 by increasing the overall weight of the glider 100. The buoyancy engine 130 can dispel the aqueous medium from the ballast tank by filling the ballast tanks with a compressed gas, such as air, or another liquid lighter than the aqueous medium, such as a natural oil. Dispelling the aqueous medium from the ballast tanks can increase the buoyancy of the glider 100 due to a decreased overall weight of the glider 100.

The buoyancy engine 130 can adjust a center of gravity of the glider 100. For example, the buoyancy engine 130 can include a sled on which, or in which, one or more components are disposed, e.g., the data processing system 135, batteries, a battery management system, etc. The buoyancy engine 130 can include at least one motor or actuator that moves the sled within the middle portion 115 towards the front portion 110, away from the front portion 110, towards the rear portion 120, or away from the rear portion 120. By changing the buoyancy and center-of-gravity of the glider 100, the buoyancy engine 130 can propel or move the glider 100 through or relative to the aqueous medium in a plurality of directions (e.g., through a combination of gliding, sinking and/or floating dynamics, even if there is no active/powered propulsion system) which can include partially horizontal directions. At least one data processing system 135 can be disposed, included, installed, or provided within the middle portion 115. The data processing system 135 can collect measurements from the sensor 125. The data processing system 135 can generate commands, control decisions, and/or operations to cause the buoyancy engine 130 to change buoyancy or change a center-of-gravity of the glider 100. The data processing system 135 can control the buoyancy engine 130 to cause the glider 100 to ascend, descend, set a particular speed or velocity for the glider 100, set a glide angle for the glider 100, or set an angle of attack, or set an orientation (e.g., to point a sensor in a certain direction) for the glider 100.

The rear portion 120 can be a stern, trailing surface, or trailing portion of the glider 100. The rear portion 120 can include at least one component 140. The component 140 can be formed from, or include, plastic, aluminum, or steel, as nonlimiting examples. The component 140 can have a frustum or cone shape. The component 140 can be hollow or solid. The component 140 can include openings on opposite sides of the component 140. The openings can be circular in shape. The component 140 can have an outer circumference or diameter that decreases or tapers from the middle portion 115 to a tail end of the glider 100. The ring wing or ring foil 105 can be coupled, fixedly coupled, connected, joined, formed integrally with, or attached to the component 140.

The rear portion 120 can include at least one ring wing 105. The ring wing 105 can be formed from, or include, plastic, aluminum, steel or other material(s). The ring wing 105 can be or include outer surfaces that provide lift for the glider 100. The ring wing 105 can include/be a complete ring/circular structure or a partial ring/circular structure. For example, the ring wing 105 can be formed from one or more segments of a ring structure, some of which can be independently or collectively pivoted or tilted to achieve particular lift and/or steering dynamics relative to the flow or displacement of the aqueous medium. The ring wing 105 can convert a hydrostatic force acting on the glider 100 to an upwards lift (e.g., upwards away from the ocean floor or a surface over which the glider 100 travels). When the glider 100 glides upwards away from a reference point under the glider 100, the ring wing 105 can provide a lifting force to propel the glider 100, e.g., along at least a partially horizontal direction. When the glider 100 glides downwards towards a reference point under the glider 100, the ring wing can provide a lifting force to propel the glider 100, e.g., along at least a partially horizontal direction. The glider 100 can be propelled through the aqueous medium by leveraging on the lift of the lifting surface(s) of the ring wing 105. The glider 100 can use lift from the ring wing 105 to travel laterally or achieve significant horizontal range. The glider 100 may not include or have to rely on any other thruster or propeller to generate lateral travel.

The overall length of the glider 100 can be 0.9 meters long, as an example. The overall length of the glider 100 can be 0.8-1.0 meters long. The overall length of the glider 100 can be less than 0.8 meters. The overall length of the glider 100 can be greater than 1.0 meter long. A diameter of the fuselage 115 of the glider 100 can be 12-13 centimeters. The diameter of the fuselage 115 of the glider 100 can be 11-14 centimeters. The diameter of the fuselage 115 of the glider 100 can be less than 11 centimeters. The diameter of the fuselage 115 of the glider 100 can be greater than 14 centimeters. The cone 120 can have (or be at) an angle 155 relative between an outer surface of the middle portion 115 and an outer surface of the cone 120. The angle 155 can be 17-19 degrees. The angle 155 can be 16-20 degrees. The angle 155 can be less than 16 degrees. The angle 155 can be greater than 20 degrees.

The ring wing 105 can have an outer diameter of 11-12 centimeters. The ring wing 105 can have an outer diameter of 10-13 centimeters. The ring wing 105 can have an outer diameter less than 10 centimeters. The ring wing 105 can have an outer diameter greater than 13 centimeters. The ring wing 105 can have a chord length of 2-3 centimeters. The ring wing 105 can have a chord length 1.5-3.5 centimeters. The ring wing 105 can have a chord length less than 1.5 centimeters. The ring wing 105 can have a chord length greater than 3.5 centimeters. A ratio between the outer diameter of the ring wing 105 and a length or chord of the ring wing 105 can be greater than, or equal to one. The ratio between the outer diameter of the ring wing 105 and the chord of the ring wing 105 can be between 2.9-3.1. The ratio between the outer diameter of the ring wing 105 and the chord of the ring wing 105 can be between 2.8-3.2. The ratio between the outer diameter of the ring wing 105 and the chord can be less than 2.8. The ratio between the outer diameter of the ring wing 105 and the chord can be greater than 3.2.

Referring to FIG. 2-5, among others, a ring wing 105 of a submersible glider 100 is shown. The ring wing 105 can be coupled at an end of the component 140. For example, the component 140 can have a length 205. An outer surface 215 can taper along the length 205. For example, the component 140 can be, or include, a frustrum or have a frustum shape. The frustum can start at a plate 210 where the frustum has a largest outer diameter and extend to towards the ring wing 105 or away from the middle portion 115 or front portion 110. The frustum shape can extend to a coupling with the ring wing 105, where the frustum shape has a smallest outer circumference.

The component 140 can be at least partially hollow. A shaft, arm, linkage, or elongated member 220 can be at least partially disposed within the component 140. The member 220 can include a portion 230, a portion 405, and a portion 410. The portions 230, 405, or 410 can be integrally formed, or coupled together at ends of the portion 230, 405, or 410 via a weld, connector, snap, bolt, or telescoping apparatus. The member 220 can be formed from aluminum, steel, or a plastic.

The member 220 can extend from a first side of the plate 210 through an opening 225 in the plate 210 to a second side of the plate 210. The second side of the plate 210 can be opposite the first side of the plate 210. The opening 225 can have a circular or cylindrical shape. An actuator 235 such as a motor, gear box, linkage apparatus, or a solenoid can be coupled with the plate 210. The actuator 235 can rotate the member 220 along a longitudinal axis of a portion 230 of the member 220. The longitudinal axis of the portion 230 can be parallel with a longitudinal axis of the component 140 or a longitudinal axis 150 of the glider 100.

The portion 230 can include a first end that couples with the actuator 235. The actuator 235 can exert or apply a rotational force on the first end of the portion 230 to cause the member 220 to rotate about the longitudinal axis of the portion 230. A second end of the portion 230 can be coupled with a first end of a portion 405 of the member 220. The portion 405 and the portion 230 can be perpendicular to each other. The portion 405 and the portion 230 can meet at an angle. The angle can be 90 degrees. The angle can be 80-100 degrees. The angle can be 75-105 degrees. The angle can be less than 75 degrees. The angle can be greater than 105 degrees. The portion 405 can extend from an end of the portion 230 to an end of the portion 410. The portion 405 can extend away from a stabilizer 415 or away from a surface of the portion 230. The portion 405 can extend at an angle perpendicular to a longitudinal axis of the portion 230, a longitudinal axis of the portion 140, or a longitudinal axis 150 of the glider 100.

A portion 410 can extend from an end of the portion 405 towards the ring wing 105. The portion 410 can extend in a direction parallel with the portion 230, with a longitudinal axis of the portion 230, with a longitudinal axis of the member 140, or a longitudinal axis 150 of the glider 100. The portion 405 and the portion 410 can meet at an angle. The angle can be 90 degrees. The angle can be 80-100 degrees. The angle can be 75-105 degrees. The angle can be less than 75 degrees. The angle can be greater than 105 degrees. The portion 410 can extend to a pin 420. The pin 420 can couple the member 220 with the ring wing 105.

The ring wing 105 can include an outer ring 240. The outer ring 240 can be disposed about or around at least a portion of an inner ring 245. The ring wing 105 can be integrally formed, or can be formed from discrete components that are coupled, fastened, or connected together. The outer ring 240 can have an airfoil or hydrofoil shape, surface, or structure. The inner ring 245 can have an airfoil or hydrofoil shape, surface, or structure. The outer ring 240 and/or the inner ring 245 may be configured to provide lift (e.g., hydrostatic lift) in one or more directions relative to the flow/displacement of a surrounding medium. The ring wing 105 can include wings, spokes, or members 250 that extend between the outer ring 240 and the inner ring 245. The members 250 can extend from an inner surface of the outer ring 240 to an outer surface of the inner ring 245. The ring wing 105 is shown to include five members 250. The members 250 can be spaced in equal distances from each other or in unequal distances from each other. The members 250 can have an airfoil or hydrofoil shape or structure, e.g., configured to provide lift (e.g., hydrostatic lift) in one or more directions relative to the flow/displacement of a surrounding medium.

The members 250 can extend at an angle 265 from the outer ring 240 to the inner ring 245. The members 250 can extend from the outer ring 240 in a direction towards the middle portion 115 or the front portion 110. An angle 265 formed between an inner surface of the outer ring 240 and a trailing edge of a member 250 can be 110-120 degrees. The angle 265 can be 105-125 degrees. The angle 265 can be less than 105 degrees. The angle can be greater than 125 degrees. The angles 265 formed between the inner surface of the outer ring 240 and the trailing edge of the members 250 can be equal or unequal. The members 250 have a wing shape, such as an airfoil shape or a hydrofoil shape.

A trailing boundary 255 of the outer ring 240 can be offset from an trailing boundary 260 of the inner ring 245. For example, the end or edge 255 of the outer ring 240 can extend past an end or edge 260 of the inner ring 245 in a direction away from the middle portion 115 or front portion 110 of the glider 100. Furthermore, a leading boundary 425 of the inner ring 245 can be offset from a leading boundary 430 of the outer ring 240. The leading boundary 425 can extend in a direction towards the middle portion 115 or the front portion 110.

The inner ring 245 can include a first portion 435. The inner ring 245 can include a second portion 440. The outer diameter of the first portion 435 can be greater than an outer diameter of the second portion 440. The second portion 440 can extend from an end of the first portion 435 towards the plate 210, the actuator 235, the member 230, the middle portion 115, or front portion 110 of the glider 100. At least a portion of the second portion 440 or at least a portion of the first portion 435 can extend into the member 140. For example, the outer surfaces 215 of the member 140 can meet at an opening through which at least a portion of the first portion 435 or at least a portion of the second portion 440 can extend through. The first portion 435 can be partially disposed within the member 140. The second portion 440 can be fully disposed within the member 140.

A hinge or pin 450 can enable the ring wing 105 to rotate about an axis. For example, the pin 450 can be inserted through the first portion 435 of the inner ring 245 and the portion 410 of the member 220. The ring wing 105 can rotate about a longitudinal axis of the pin 450. The outer diameter of the first portion 435 or the second portion 440 can be less than the outer diameter of the opening of the member 140 such that the ring wing 105 can rotate on the pin 450.

The ring wing 105 can pivot, move, tilt, and/or rotate about or along a vertical axis 145. For example, the ring wing 105 can tilt left or right to act as a rudder and provide direction control. The ring wing 105 can pivot about the vertical axis 145 to steer the glider 100 through the aqueous medium (e.g., while the buoyancy, weight distribution and/or center-of-gravity of the glider relative to the aqueous medium creates thrust/motion on the glider from displacement forces of the aqueous medium). For example, the ring wing 105 can pivot to steer the glider 100 laterally, e.g., left or right. For example, the actuator 235 can rotate the member 220 via a coupling between the actuator 235 and an end of the member 220. The member 220 can rotate about a longitudinal axis of the portion 220. Because the member 220 rotates about the stabilizer 415, the portions 405 and 410 can move relative to the stabilizer 415, causing the ring wing 105 to steer the glider 100.

In some implementations, the ring wing 105 can pivot, move, tilt or rotate about a horizontal axis. The horizontal axis can be perpendicular the vertical axis 145 and the longitudinal axis 150. The ring wing 105 can pivot about the horizontal axis to control a glide angle of the glider 100 or angle of attack of the glider 100. The ring wing 105 can pivot about the horizontal axis to cause/aid the glider 100 to ascend or descend through the aqueous medium. Tilting the ring wing 105 about a horizontal axis can provide for improved ascent or descent of the vehicle in the aqueous medium, or otherwise control the rate of ascent or descent in the aqueous medium.

An outer surface of the outer ring 240 can taper at an angle 505. The outer surface of the outer ring 240 can taper in a direction parallel to the tapering of the cone 215. The angle 505 can be an angle formed between an outer surface of the outer ring 240 and an outer surface of the middle portion 115. The angle 505 can be the same as or equal to the angle 155. The angle 505 can be 17-19 degrees. The angle 505 can be 16-20 degrees. The angle 505 can be less than 16 degrees. The angle 505 can be greater than 20 degrees.

Figure 6:
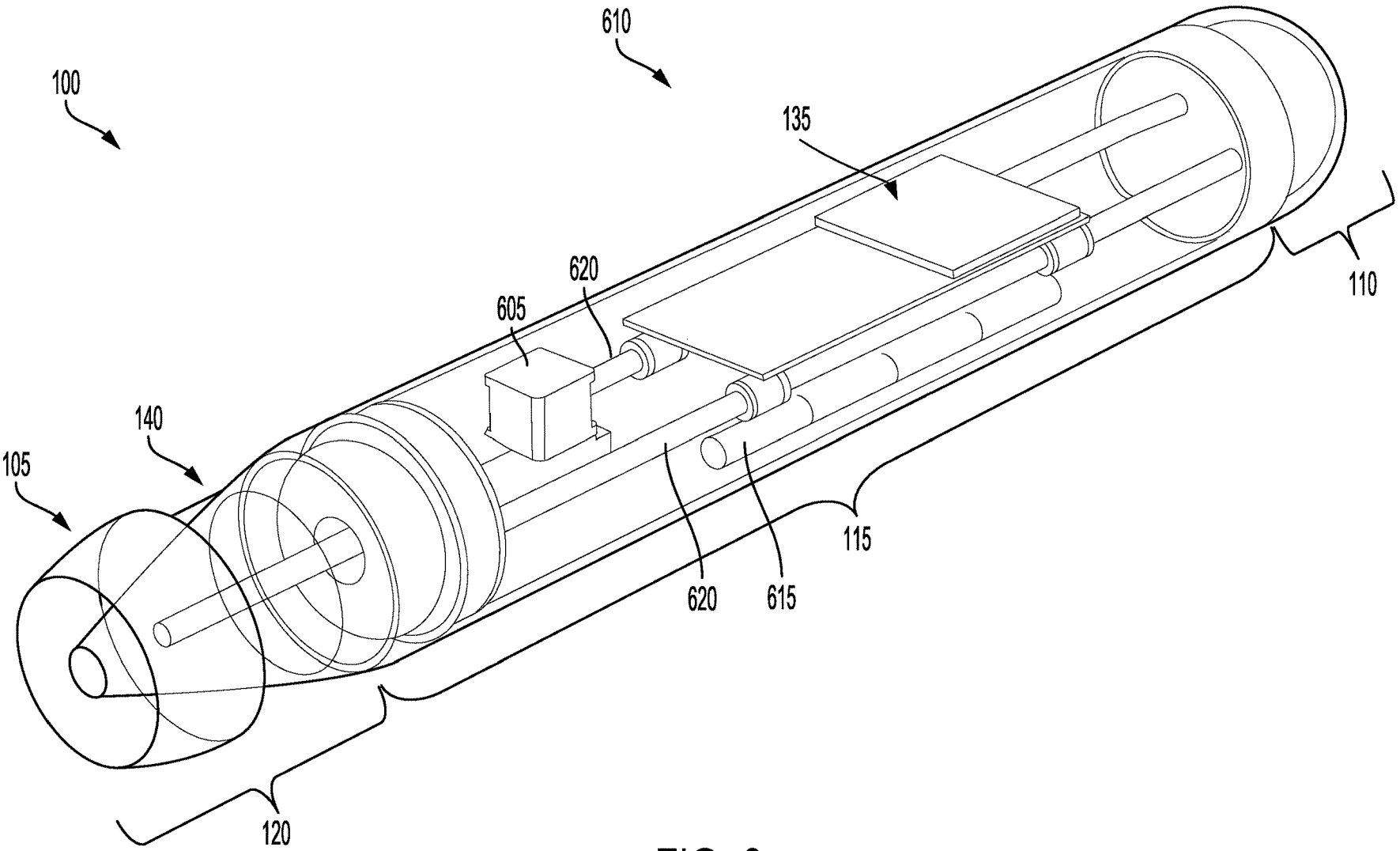
FIG. 6 is an example view of a submersible glider including a ring wing and a buoyancy engine.

Referring now to FIG. 6, among others, the submersible glider 100 including a ring wing 105 and a buoyancy engine 130 is shown. The buoyancy engine 130 can include at least one pump 605, at least one valve, at least one bladder, or at least one ballast tank. The buoyancy engine 130 can be controlled or operated by the data processing system 135 to change the buoyancy of the glider 100. The data processing system 135 can operate the buoyancy engine 130 to increase the buoyancy of the glider 100 or decrease the buoyancy of the glider 100. The buoyancy engine 130 can cause the glider 100 to rise or fall within the aqueous medium by changing the weight of the glider 100. The data processing system 135 can operate the buoyancy engine 130 to adjust a buoyancy of the glider 100 to meet a particular angle of attack or glide angle.

The buoyancy engine 130 can add a fluid to a compartment or release the fluid from the compartment within the fuselage or within the glider 100 to adjust the buoyancy of the glider. For example, the data processing system 135 can operate the buoyancy engine 130 to open or close a valve to allow an aqueous medium to enter a bladder or compartment of the buoyancy engine 130 or exit the bladder. The data processing system 135 can operate the buoyancy engine 130 to open a valve to allow an aqueous medium to enter a bladder to cause the glider 100 to become heavier and thus less buoyant. The pump 605 can be disposed within the middle portion 115. A first bladder can be disposed within the component 140. A second bladder can be disposed within the middle portion 115. The pump 605 can pump a liquid or gas that is lighter than the aqueous medium into the first bladder to dispel or displace the aqueous medium from the bladder, causing the glider 100 to become lighter and therefore more buoyant. The pump 605 can pump the liquid or gas from the second bladder into the first bladder. For example, the gas or liquid pumped into the bladder can push the aqueous medium out of the bladder and out of the glider 100 into the surrounding aqueous medium. For example, the pump 605 can pump an oil into the bladder to cause the glider 100 to become lighter and more buoyant. In some embodiments, multiple bladders located at different sections of the glider can be controlled/filled differentially or otherwise, to change/control a buoyancy, center-of-gravity and/or weight distribution of the glider. This can be used to control/adjust an orientation, direction, tilt, motion and/or displacement of the glider with respect to the aqueous medium.

The buoyancy engine 130 can include at least one sled 610. The sled 610 can be a platform, box, container, or other component. The data processing system 135 can be coupled with, fixed with, attached to, disposed within, or disposed on the sled 610. The glider 100 can include a power source 615. The power source 615 can be or include at least one battery 615, at least one super capacitor, at least one generator. The power source 615 can be coupled with, fixed with, attached to, disposed within, or disposed on the sled 610. The sled 610 can move on/along at least one rail 620.

The data processing system 135 can control at least one actuator, such as a motor, to move the sled 610 forward towards the front portion 110 of the glider 100 or backwards towards the rear portion 120 of the glider 100. In this regard, the buoyancy engine 130 can change the distribution of weight of the glider 100 along a length or the longitudinal axis 150 of the glider 100. For example, the buoyancy engine 130 can move the sled 610 forwards to place more weight forward towards the front portion 110 of the glider 100, or move the sled 610 backwards to place more weight rearwards towards the rear portion 120 of the glider 100. By changing the weight placement/distribution within the glider 100, the buoyancy engine 130 can move or control a center-of-gravity of the glider 100 to cause the glider 100 to ascend or descend through the aqueous medium.

The power source 615 can power at least one actuator, such as a motor or pump, of the glider 100. For example, via at least one electrical connection, cable, or component, the power source 615 can deliver, provide, or transfer power to the buoyancy engine 130 to adjust the buoyancy or center-of-gravity of the glider 100 in the aqueous medium. For example, the power source 615 can power the buoyancy engine 130 to control the buoyancy of the glider 100. The pump 605 can operate based on power received from the power source 615 to displace aqueous medium from a bladder of the glider 100. A valve can be operated based on power received from the power source 615 to allow an aqueous medium to enter the glider 100. Furthermore, power from the power source can be used by a motor to move the sled 610 forwards or backwards within the glider 100.

Furthermore, the power source 615 can power the actuator 235. For example, via at least one electrical connection, cable, or component, the power source 615 can deliver, provide, or transfer power to the actuator 235 to rotate or move the ring wing 105 about the vertical axis 145. For example, via the power provided by the power source 615, the data processing system 135 can operate the actuator 235 to steer the glider 100 laterally.

Figure 7:
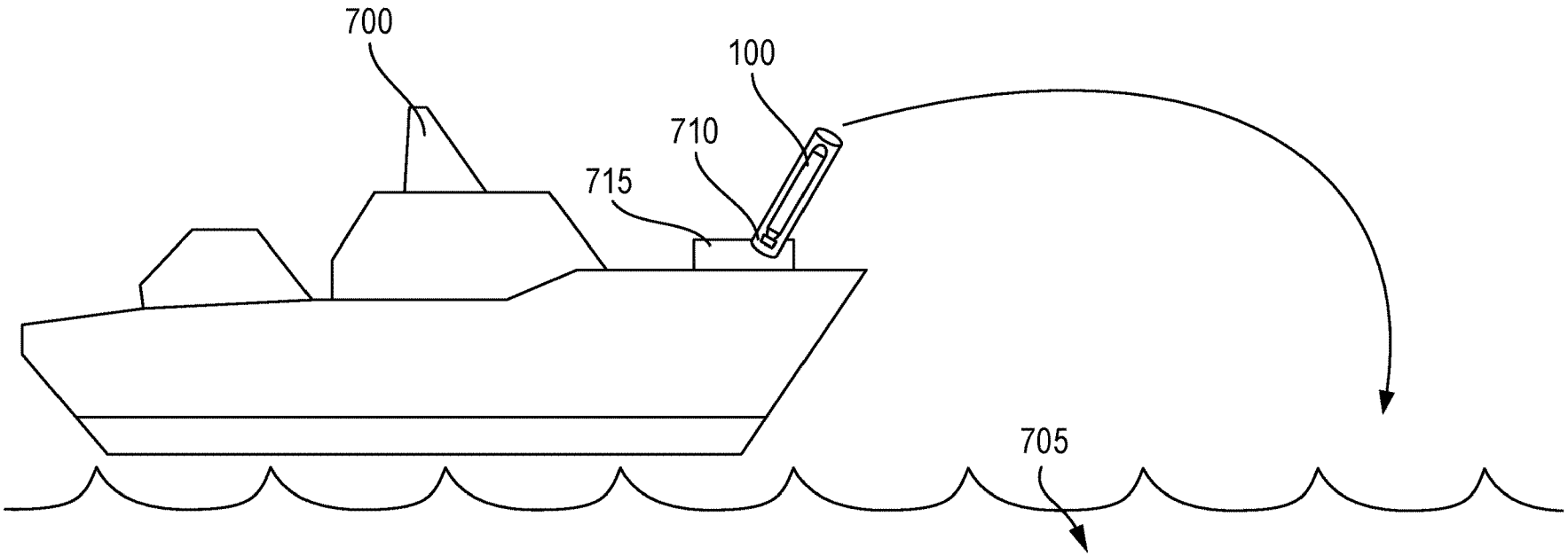
FIG. 7 is an example vehicle deploying a launch container including a submersible glider.

Referring now to FIG. 7, among others, an example vehicle 700 deploying a launch container 710 including the submersible glider 100 is shown. The glider 100 can be launched or deployed into an aqueous medium 705 from a vehicle 700. The aqueous medium 705 can be the ocean, a lake, a flooded area, a canal, or any other body of liquid, such as water. The vehicle 700 can be a maritime vehicle or a marine vehicle. The vehicle 700 can be a boat, a ship, a submarine, or another glider. The vehicle 700 can be an aerial vehicle, such as a plane, a rotorcraft, or a drone. The glider 100 can be launched from a mobile or stationary platform. The glider 100 can be launched from land, the shore, or a dock. The vehicle 700 can carry at least one launching apparatus 715 and at least one launch container 710 including gliders 100. The vehicle 700 can deploy one or multiple gliders 100 via launching containers 710 and the launching apparatus 715 as the vehicle 700 traverses, moves across, moves over, or sails on the aqueous medium 705.

The glider 100 can be loaded, inserted into, disposed in, or placed in a launch container 710. The launch container 710 can be an SLC. The SLC can be an A-Size launch container. The launch container 710 can have a cylindrical or tubular shape. The launch container 710 can be larger than, or slightly larger than, the glider 100 such that the glider 100 can fit within a cavity, opening, space, or tube of the launch container 710. In order to fit within the launch container 710, the glider 100 may not include any lateral wings or members that extend outwards from an outer surface of the middle portion 115 or the front portion 110. The glider 100 may not include any lateral wings that extend outwards more than 10 centimeters. The glider 100 may not include any lateral wings that extend outwards more than 5 centimeters. The glider 100 may not include any lateral wings that extend outwards more than 3 centimeters.

One more multiple launch containers 710 can be loaded into a launching apparatus 715. The launching apparatus 715 can be disposed on, or installed on, the vehicle 700. The launching apparatus 715 can launch the launch container 710 from the vehicle 700 to the aqueous medium 705. Once in the aqueous medium 705, the launch container 710 can open and the glider 100 can be deployed from, exit, or move out of the launch container 710. The data processing system 135, or a data processing system of the launch container 710, can cause the glider 100 to be deployed from the launch container 710. The data processing system 135 can cause the glider 100 to deploy out of the launch container 710 responsive to the launch container 710 being launched to or into the aqueous medium 705. In some implementations, a mechanical apparatus or a mechanism can detect that the launch container 10 has been launched, and can cause the launch container 710 to open and the glider 100 to deploy from the launch container 710.

Once the glider 100 is deployed from the vehicle 700 or from the launch container 710, the glider 100 can configure or deploy one or multiple components of the glider 100 for operation. For example, the glider 100 can include a mechanism 720, such as a spring, piston, or other compressible member that provides a force. The mechanism 720 can be coupled with the stern of the fuselage of the glider 100. For example, the mechanism 720 can be coupled to a rear of the rear portion 120 or a rear of the middle portion 115. The mechanism 720 can move, extend, or deploy the ring wing 105 from a first position (e.g., a stowed position) to a second position (e.g., a deployed position). The mechanism 720 can cause the ring wing 105 to move between the first position and the second position, for example, to any position between the first position and second position. For example, the mechanism 720 can move the ring wing 105 from a first position a first distance from the end of the middle portion 115 to the second position a second distance from the end of the middle portion 115 greater than the first distance. The mechanism 720 can move the ring wing 105 backwards along the longitudinal axis 150 away from a direction of travel of the glider 100.

The mechanism 720 can include a pressure switch. In some implementations, the sensor 125 can be or include a pressure sensor or pressure switch. The pressure switch can detect an increase in pressure subsequent to the glider 100 being launched into the aqueous medium 705. Responsive to detecting a pressure increase, e.g., a pressure of the aqueous medium 705 on the glider 100 exceeding or satisfying a threshold, the pressure switch can activate the mechanism to deploy the ring wing 105. For example, the mechanism 720 can be in a locked position or state. The pressure switch can unlock the mechanism 720 responsive to the pressure satisfying or exceeding the threshold, to cause the ring wing 105 to be moved or extended from the first position to the second position. The pressure switch can cause the ring wing 105 to move between the first position and the second position, for example, to any position between the first position and second position.

Figure 8:
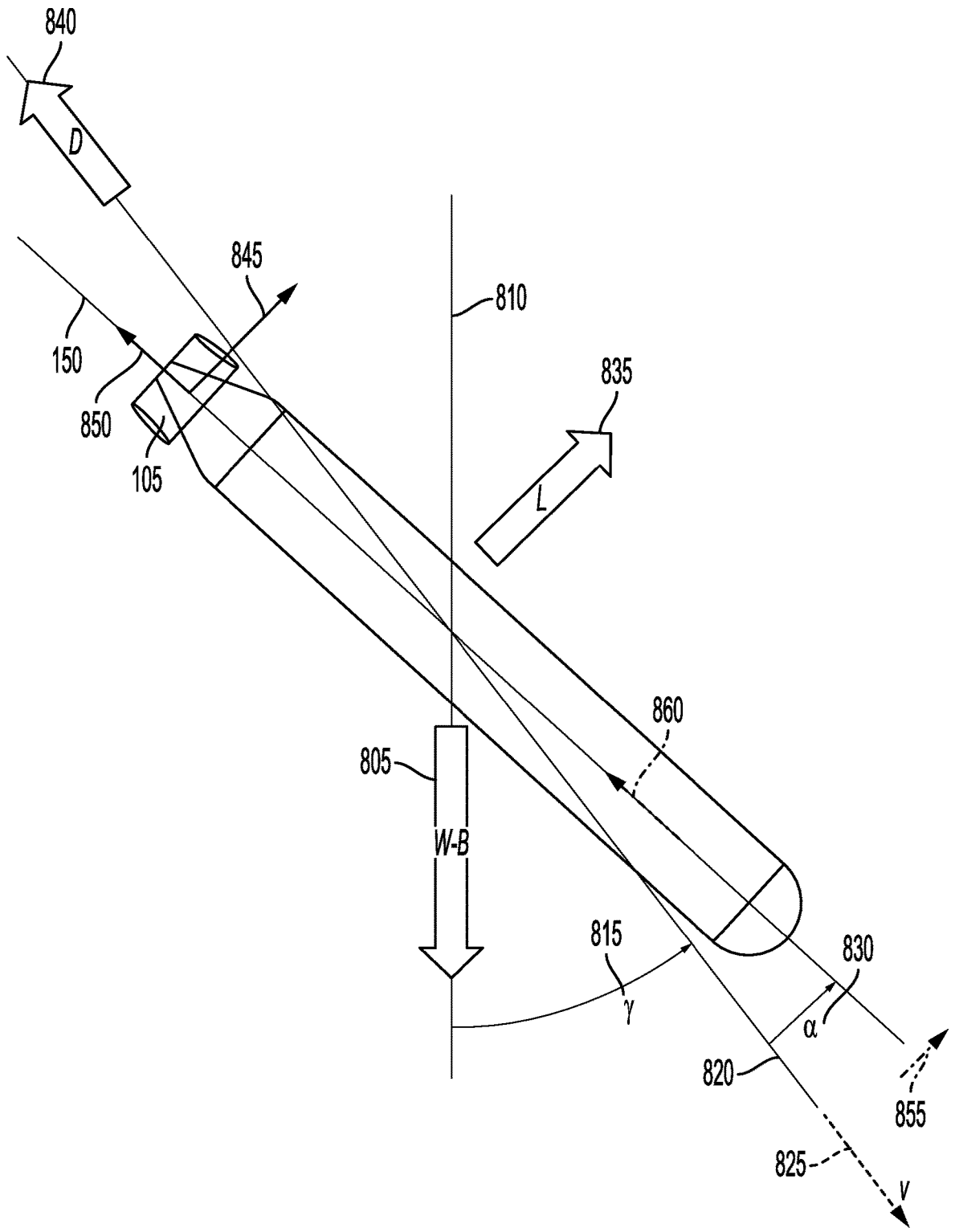
FIG. 8 is an example of hydrostatic, drag, and lifting forces of a submersible glider including a ring wing.

Referring now to FIG. 8, among others, an example of hydrostatic, drag, and lifting forces on a submersible glider including a ring wing are shown. Hydrostatic forces 805 acting on the glider 100 along the vertical axis 810 can include weight or wet weight (W) and buoyancy (B). The weight can be varied with the buoyancy engine 130 to cause the glider 100 to ascend or descend. A pitch or a glide path or angle 815 of the glider 100 can be controlled by the buoyancy engine 130. The glide angle 815 can be an angle between a direction of travel 820 of the glider 100 and the vertical axis 810, where the glider 100 travels along the direction 820 at some velocity 825. The vertical axis 810 can be an angle perpendicular to a horizon. An angle between the longitudinal axis 150 of the glider 100 and the direction of travel 820 can be an angle of attack 830. The heading of the glider 100 can be controlled via actuator of the ring wing 105 about a single axis, such as the vertical axis 145. A lifting force 835 and a drag force 840 are also shown in FIG. 8. The lifting force 835 can be a force perpendicular to a surface of the middle portion 115 of the glider. The lifting force 835 can be a total lifting force of the glider 100. The drag force 840 can be a total drag of the glider 100 opposite to a direction of travel 820 of the glider 100.

FIG. 8 illustrates the lift 845 and drag 850 created by the ring wing 105. The drag 850 is shown along the longitudinal axis 150 of the glider 100. The lift 845 is shown perpendicular to the longitudinal axis 150 of the glider 100. The lift 845 can be created by the outer ring 240, the inner ring 245, or the members 250. The drag 850 can be created by the outer ring 240, the inner ring 245, or the members 250. The lift 855 and the drag 860 caused by the fuselage of the glider 100 (e.g., the front portion 110, the middle portion 115, and the rear portion 120) are also illustrated in FIG. 8. The drag 860 is shown along the longitudinal axis 150 of the glider 100. The lift 855 is shown perpendicular to the longitudinal axis 150 of the glider 100.

Figure 9:
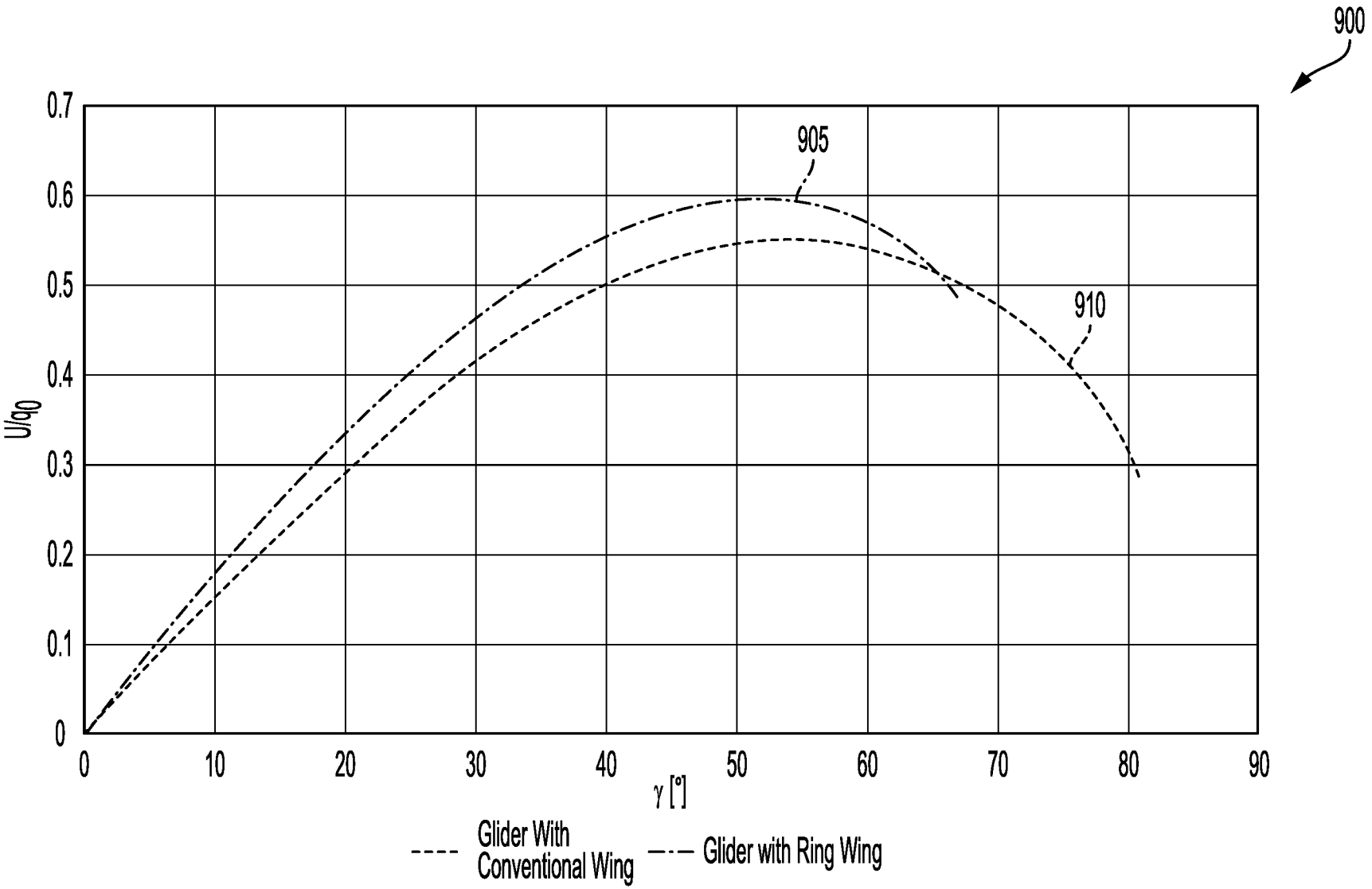
FIG. 9 is an example chart of velocity versus glide angle of a submersible glider including a ring wing and a submersible glider including a conventional wing.

Referring now to FIG. 9, an example chart 900 of velocity versus glide angle of a submersible glider 100 including a ring wing 105 and a submersible glider 100 including a conventional wing is shown. The conventional wings can extend at an angle perpendicular to the longitudinal axis 150 outward from an outer surface of the middle portion 115. The results shown in the chart 900 can be based on an A-size glider 100 including an overall length of 36 inches, a fuselage diameter of 4 and ⅞ inches, a transom stern diameter of 1 inch, and an afterbody cone angle of 18 degrees. The ring wing 105 of the glider 100 can include a diameter of 4.5 inches and a chord of 1.5 inches. The conventional wings can include a wing span of 24 inches and a chord of 2 inches.

In the chart 900, the vertical axis can be a lateral velocity component 825, while the horizontal axis can be glide angle 815 for angles of attack 830 up to 11.25 degrees. The value do can be a reference velocity for a wingless configuration where the angle of attack 830 and the glide angle 815 are zero (e.g., the glider 100 is moving straight down along the vertical axis 810). The chart 900 includes a trend 905 for glide angle versus velocity for the glider 100 including the ring wing 105. The chart 900 includes a trend 910 for glide angle versus velocity for the glider including a conventional wing. The chart 900 indicates that the glider 100 that does not include conventional wings and instead includes a ring wing 105 has a superior ability to attain horizontal velocity. In contrast, the glider including the conventional wings incurs the additional drag of the conventional wings without taking advantage of the lift provided by the conventional wings to reduce angle of attack 830 and the associated drag. The chart 900 further indicates that the glider 100 including the ring wing 105 can have sufficient horizontal velocity to station keep in currents typical of coastal areas, without needing conventional wings.

The weight and center-of-gravity of the glider 100 can be controlled by the data processing system 135 operating the buoyancy engine 130 to achieve an ideal or optimal operating scenario for lateral movement. In the ideal operating scenario, the speed 825 may reach a top speed. In the chart 900, the top speed 825 of the glider 100 can be achieved at a glide angle 815 of 51.9 degrees and an angle of attack 830 of 5.5 degrees. At this top speed, the drag of the fuselage can be 0.43 newton (N). The lift provided by the fuselage can be 0.23 N. The weight 805 of the glider 100 can 10.87 N while the buoyancy can be 9.87 N. The lift provided by the ring wing 105 can be 0.6 N while the drag of the ring wing 105 can be 0.10 N. This operating scenario can be an ideal or optimal operating point, where the weight minus the buoyancy is 1 N, providing operational gliding performance for the glider 100. In this regard, the forces on the glider 100 at the ideal lateral progress can have a 1N wet weight including normal and axial hydrodynamic forces on the fuselage and ring wing plus weight and buoyancy. The forces indicated can result in a pitching moment of zero.

Figure 10:
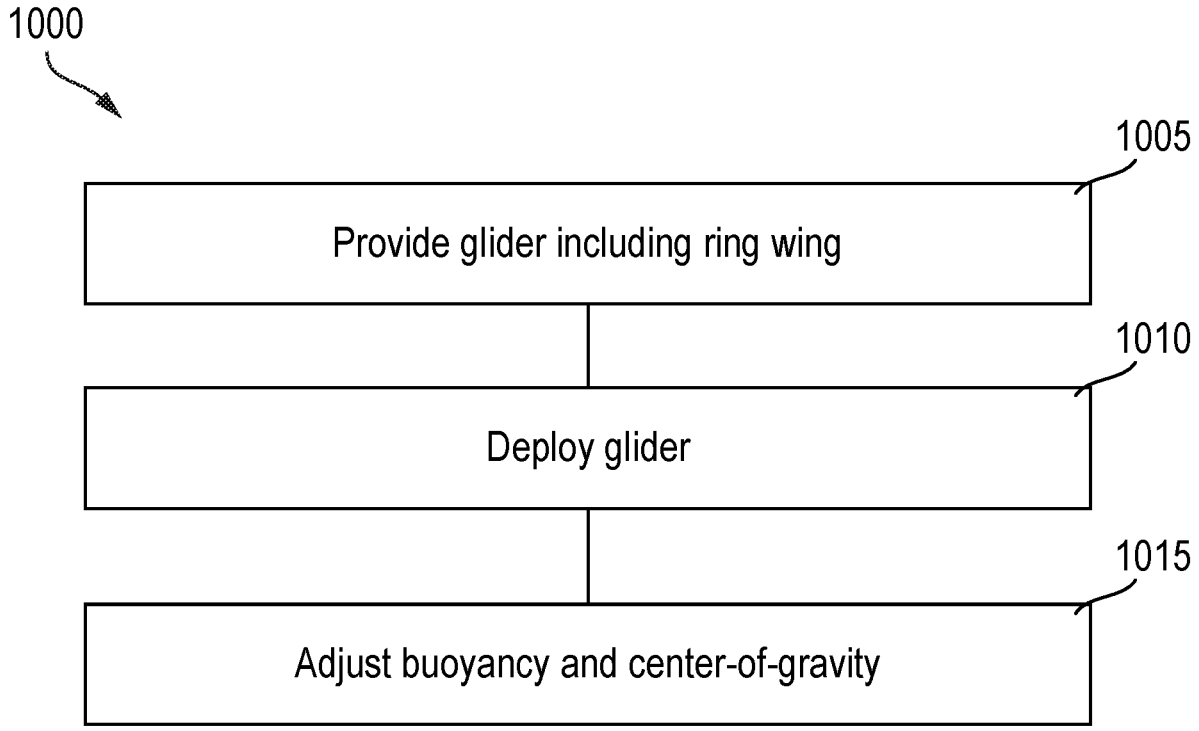
FIG. 10 is an example method of a submersible glider including a ring wing.

Referring now to FIG. 10, among others, an example method 1000 of a submersible glider 100 including a ring wing 105 is shown. At least a portion of the method 1000 can be performed by the glider 100, the data processing system 135, the buoyancy engine 130, the ring wing 105, the launch container 710, the launching apparatus 715, or the vehicle 700. At least a portion of the method 1000 can be performed by a manufacturing apparatus, system, or individual. The method 1000 can include an ACT 1005 of providing a glider including a ring wing. The method 1000 can include an ACT 1010 of deploying a glider. The method 1000 can include an ACT 1015 of adjusting buoyancy and a center-of-gravity of a glider.

At ACT 1005, the method 1000 can include providing or deploying a glider 100 including a ring wing 105. The method 1000 can include manufacturing or creating a middle portion 115. The method 1000 can include installing or mounting components into the middle portion 115, e.g., the sled 610, the rails 620, the data processing system 135, the buoyancy engine 130, the pump 605. The method 1000 can include pressurizing the middle portion 115. The method 1000 can include pressurizing the middle portion 115, such as a pressure hull, to 0.9-1.1 atmospheres of pressure. The method 1000 can include pressurizing the middle portion 115, such as a pressure hull, to 0.8-1.2 atmospheres of pressure. The method 1000 can include pressurizing the middle portion 115, such as a pressure hull, to a pressure less than 0.8 atmospheres of pressure. The method 1000 can include pressurizing the middle portion 115, such as a pressure hull, to a pressure more than 1.2 atmospheres of pressure.

The method 1000 can include installing, disposing, activating and/or placing a sensor 125 within the front portion 110. The method 1000 can include coupling the sensor 125 with the data processing system 135. The method 1000 can include coupling the front portion 110 with a front of the middle portion 115. The method 1000 can include coupling the component 140 with the rear of the middle portion 115. For example, an end including a largest or greatest diameter of a cone 140 can be coupled with the rear end of the middle portion 115. A ring wing 105 can be coupled with an end of the cone 140. The ring wing 105 can be coupled with a small or smallest diameter end of the cone 140.

The method 1000 can include manufacturing or creating the ring wing 105. The method 1000 can include manufacturing the ring wing 105 as a single component with multiple parts or members integrally formed. The method 1000 can include manufacturing the ring wing 105 in separate or discrete parts, which can be coupled, connected, or joined together with rivets, snaps, adhesives, bolts, or screws. The ring wing 105 can be manufactured to have an outer ring 240 and an inner ring 245. The outer ring 240 and the inner ring 245 can have hydrofoil or airfoil shapes that generate lift based on liquid flow or displacement over or across the outer ring 240 or the inner ring 245. At least one member 250 can extend between the outer surface of the inner ring 245 and an inner surface of the outer ring 240. The members 250 can be airfoil or hydrofoil shapes, and generate lift based on liquid flow or displacement over or across the members 250.

At ACT 1010, the method 1000 can include deploying the glider 100. The method 1000 can include installing, disposing, or placing the glider 100 within a launch container 710. The launch container 710 can have a cylindrical shape that the glider 100 can fit within. An operator, machine, or robotic assembly can load the glider 100 into the launch container 710. The launch container 710 can be loaded, installed, or placed into the launch container 710. The launch container 710 can be deployed, launched, or shot out by the launching apparatus 715. The launching apparatus 715 can deploy the launch container 710 to or into the aqueous medium 705. The glider 100 can be deployed from or exit the launch container 710 into the aqueous medium 705. For example, a pressure switch or other detector can sense, detect, or identify when the launch container 710 or glider 100 enters the aqueous medium or reaches a particular depth in the aqueous medium. The pressure switch can cause the container 710 to open so that the glider 100 can exit the container 710 into the aqueous medium 705.

At ACT 1015, the method 1000 can include adjusting buoyancy and a center-of-gravity of the glider 100. The data processing system 135 can operate the buoyancy engine 130 to increase or decrease the weigh or buoyancy of the glider 100. For example, the buoyancy engine 130 can cause a bladder or area of the glider 100 to take on weight (or reduce buoyancy) by opening a valve to allow the aqueous medium 705 to enter the bladder. This can cause the glider 100 to descend. To cause the glider 100 to rise, the data processing system 135 can cause the glider to decrease in weight (or increase buoyancy) by operating a pump 605 to dispel the aqueous medium 705 from the bladder out of the glider 100. Compressed air or oil can be pumped into the bladder to dispel the aqueous medium 705 from the bladder to cause the glider 100 to decrease in weight and thus rise.

Furthermore, the glider 100 can adjust the center-of-gravity of the glider 100 to control the glide angle 815 and/or orientation of the glider 100. The glide angle 815 of the glider 100 can be controlled by controlling one of the center-of-gravity or the weight of the glider 100. The glide angle of the glider 100 can be controlled by controlling both the center-of-gravity and the weight of the glider 100. The data processing system 135 can operate motor or other actuator that causes the sled 610 to move forward towards the front portion 110 of the glider 100 or away from the rear portion 120 of the glider. The data processing system 135 can operate the motor or other actuator to cause the sled 610 to move backwards towards the rear portion 120 of the glider 100 or away from the front portion 110 of the glider 100. The data processing system 135 can operate the actuator 235 to turn, rotate, or move the ring wing 105 about the vertical axis 145. This can control the lateral direction of the glider 100.

The data processing system 135 can operate the glider 100 to station keep, or stay next to or near a set location or within a set geographical region. For example, the data processing system 135 can cyclically cause the glider 100 to have steep glide angles 815 to descend to a particular depth, and then ascend to another depth. This cycling between a small glide angle 815 to descend (near zero glide angles 815), and a large glide angle 815 to rise (near 180 degrees glide angle 815) can cause the glider 100 to stay within the area for an extended duration of time. In this regard, the glider 100 can station keep for an extended duration of time, e.g., days, weeks, or months. This can be significantly longer than the station keeping of a sonobuoy, which may become unoperational or sink to the bottom of the aqueous medium 705 after only hours of operation.

The data processing system 135 can operate the actuator 235 to position the ring wing 105 to increase or optimize the velocity of the glider 100. For example, the data processing system 135 can collect a sensor data set from sensors (such as the sensor 125) or operational pieces of information. For example, the data processing system 135 can collect information such as depth, pressure, current velocity 825 of the glider 100, glide angle 815 of the glider 100, etc. The data processing system 135 can determine a control command based on the information. For example, the control command can be an indication to move the ring wing 105 about horizontal axis or vertical axis. The control command can indicate a position to move the ring wing 105 to. Responsive to generating the command, the data processing system 135 can operate the actuator 235 to rotate, move, or turn the ring wing 105 to the position based on the control command and thus increase the velocity 825 of the glider 100. The data processing system 135 can iteratively, adaptively, or dynamically position the ring wing 105 until a maximum velocity 825 is identified.

Figure 11:
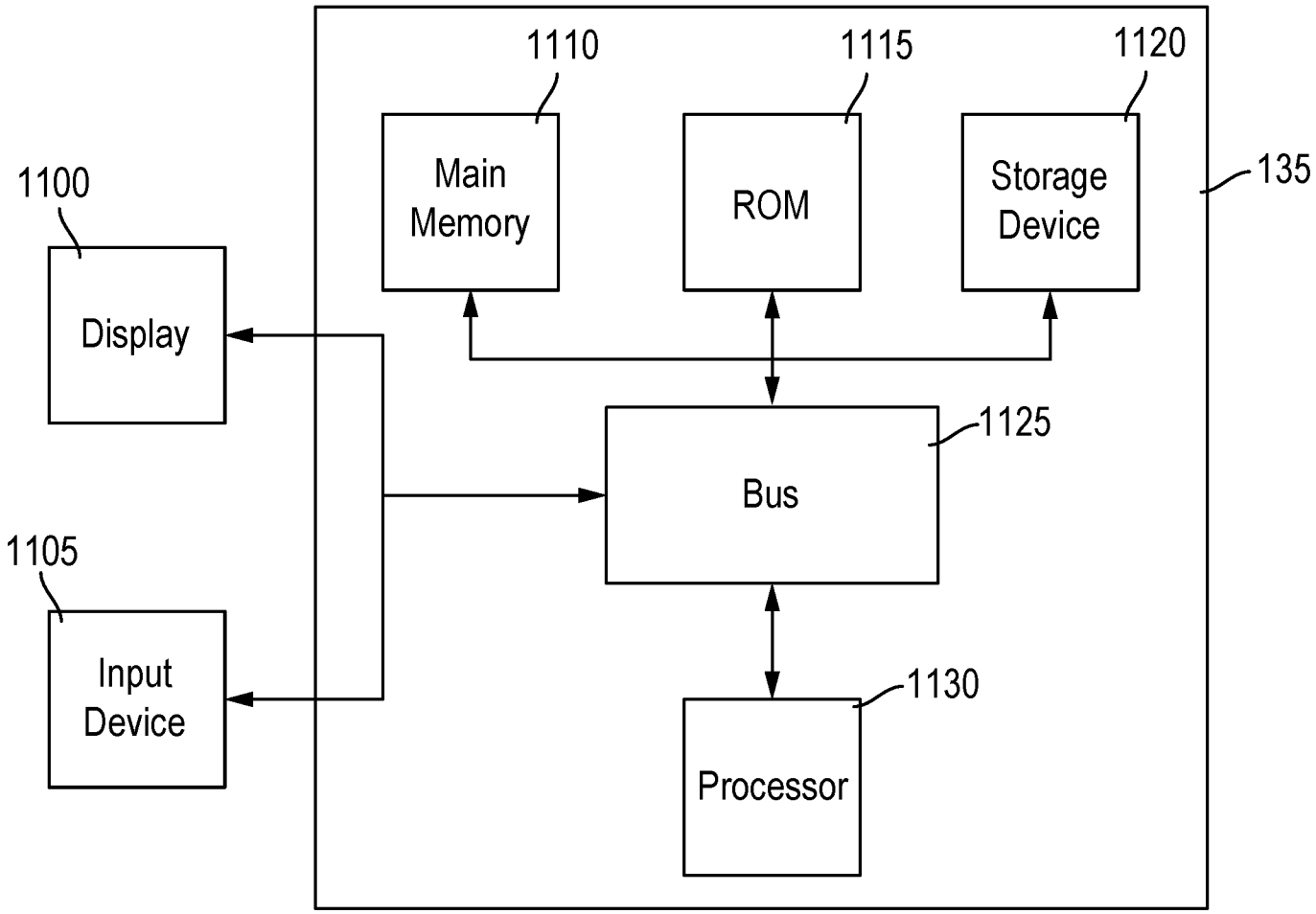
FIG. 11 is an example computing architecture of a data processing system of a submersible glider.

Referring now to FIG. 11, among others, is an example computing architecture of a data processing system 135 of a submersible glider 100 is shown. The data processing system 135 can include or be used to implement a data processing system or its components. The data processing system 135 can include at least one bus 1125 or other communication component for communicating information and at least one processor 1130 or processing circuit coupled to the bus 1125 for processing information. The data processing system 135 can include one or more processors 1130 or processing circuits coupled to the bus 1125 for processing information. The data processing system 135 can include at least one main memory 1110, such as a random access memory (RAM) or other dynamic storage device, coupled to the bus 1125 for storing information, and instructions to be executed by the processor 1130. The main memory 1110 can be used for storing information during execution of instructions by the processor 1130. The data processing system 135 can further include at least one read only memory (ROM) 1115 or other static storage device coupled to the bus 1125 for storing static information and instructions for the processor 1130. A storage device 1120, such as a solid state device, magnetic disk or optical disk, can be coupled to the bus 1125 to persistently store information and instructions.

The data processing system 135 can be coupled via the bus 1125 to a display 1100, such as a liquid crystal display, or active matrix display. The display 1100 can display information to a user. An input device 1105, such as a keyboard or voice interface can be coupled to the bus 1125 for communicating information and commands to the processor 1130. The input device 1105 can include a touch screen of the display 1100. The input device 1105 can include a cursor control, such as a mouse, a trackball, or cursor direction keys, for communicating direction information and command selections to the processor 1130 and for controlling cursor movement on the display 1100.

The processes, systems and methods described herein can be implemented by the data processing system 135 in response to the processor 1130 executing an arrangement of instructions contained in main memory 1110. Such instructions can be read into main memory 1110 from another computer-readable medium, such as the storage device 1120. Execution of the arrangement of instructions contained in main memory 1110 causes the data processing system 135 to perform the illustrative processes described herein. One or more processors in a multi-processing arrangement can be employed to execute the instructions contained in main memory 1110. Hard-wired circuitry can be used in place of or in combination with software instructions together with the systems and methods described herein. Systems and methods described herein are not limited to any specific combination of hardware circuitry and software.

Although an example computing system has been described in FIG. 11, the subject matter including the operations described in this specification can be implemented in other types of digital electronic circuitry, or in computer software, firmware, or hardware, including the structures disclosed in this specification and their structural equivalents, or in combinations of one or more of them.

Some of the description herein emphasizes the structural independence of the aspects of the system components or groupings of operations and responsibilities of these system components. Other groupings that execute similar overall operations are within the scope of the present application. Modules can be implemented in hardware or as computer instructions on a non-transient computer readable storage medium, and modules can be distributed across various hardware or computer based components.

The systems described above can provide multiple ones of any or each of those components and these components can be provided on either a standalone system or on multiple instantiations in a distributed system. In addition, the systems and methods described above can be provided as one or more computer-readable programs or executable instructions embodied on or in one or more articles of manufacture. The article of manufacture can be cloud storage, a hard disk, a CD-ROM, a flash memory card, a PROM, a RAM, a ROM, or a magnetic tape. In general, the computer-readable programs can be implemented in any programming language, such as LISP, PERL, C, C++, C#, PROLOG, Python, or in any byte code language such as JAVA. The software programs or executable instructions can be stored on or in one or more articles of manufacture as object code.

Example and non-limiting module implementation elements include sensors providing any value determined herein, sensors providing any value that is a precursor to a value determined herein, datalink or network hardware including communication chips, oscillating crystals, communication links, cables, twisted pair wiring, coaxial wiring, shielded wiring, transmitters, receivers, or transceivers, logic circuits, hard-wired logic circuits, reconfigurable logic circuits in a particular non-transient state configured according to the module specification, any actuator including at least an electrical, hydraulic, or pneumatic actuator, a solenoid, an op-amp, analog control elements (springs, filters, integrators, adders, dividers, gain elements), or digital control elements.

The subject matter and the operations described in this specification can be implemented in digital electronic circuitry, or in computer software, firmware, or hardware, including the structures disclosed in this specification and their structural equivalents, or in combinations of one or more of them. The subject matter described in this specification can be implemented as one or more computer programs, e.g., one or more circuits of computer program instructions, encoded on one or more computer storage media for execution by, or to control the operation of, data processing apparatuses. Alternatively or in addition, the program instructions can be encoded on an artificially generated propagated signal, e.g., a machine-generated electrical, optical, or electromagnetic signal that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. While a computer storage medium is not a propagated signal, a computer storage medium can be a source or destination of computer program instructions encoded in an artificially generated propagated signal. The computer storage medium can also be, or be included in, one or more separate components or media (e.g., multiple CDs, disks, or other storage devices including cloud storage). The operations described in this specification can be implemented as operations performed by a data processing apparatus on data stored on one or more computer-readable storage devices or received from other sources.

The terms "computing device", "component" or "data processing apparatus" or the like encompass various apparatuses, devices, and machines for processing data, including by way of example a programmable processor, a computer, a system on a chip, or multiple ones, or combinations of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, app, script, or code) can be written in any form of programming language, including compiled or interpreted languages, declarative or procedural languages, and can be deployed in any form, including as a stand-alone program or as a module, component, subroutine, object, or other unit suitable for use in a computing environment. A computer program can correspond to a file in a file system. A computer program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatuses can also be implemented as, special purpose logic circuitry, e.g., an FPGA (field programmable gate array) or an ASIC (application specific integrated circuit). Devices suitable for storing computer program instructions and data can include non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

The subject matter described herein can be implemented in a computing system that includes a back end component, e.g., as a data server, or that includes a middleware component, e.g., an application server, or that includes a front end component, e.g., a client computer having a graphical user interface or a web browser through which a user can interact with an implementation of the subject matter described in this specification, or a combination of one or more such back end, middleware, or front end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While operations are depicted in the drawings in a particular order, such operations are not required to be performed in the particular order shown or in sequential order, and all illustrated operations are not required to be performed. Actions described herein can be performed in a different order.

Having now described some illustrative implementations, it is apparent that the foregoing is illustrative and not limiting, having been presented by way of example. In particular, although many of the examples presented herein involve specific combinations of method acts or system elements, those acts and those elements may be combined in other ways to accomplish the same objectives. ACTs, elements and features discussed in connection with one implementation are not intended to be excluded from a similar role in other implementations.

The phraseology and terminology used herein is for the purpose of description and should not be regarded as limiting. The use of "including" "comprising" "having" "containing" "involving" "characterized by" "characterized in that" and variations thereof herein, is meant to encompass the items listed thereafter, equivalents thereof, and additional items, as well as alternate implementations consisting of the items listed thereafter exclusively. In one implementation, the systems and methods described herein consist of one, each combination of more than one, or all of the described elements, acts, or components.

Any references to implementations or elements or acts of the systems and methods herein referred to in the singular may also embrace implementations including a plurality of these elements, and any references in plural to any implementation or element or act herein may also embrace implementations including only a single element. References in the singular or plural form are not intended to limit the presently disclosed systems or methods, their components, acts, or elements to single or plural configurations. References to any ACT or element being based on any information, act or element may include implementations where the act or element is based at least in part on any information, act, or element.

Any implementation disclosed herein may be combined with any other implementation or example, and references to "an implementation," "some implementations," "one implementation" or the like are not necessarily mutually exclusive and are intended to indicate that a particular feature, structure, or characteristic described in connection with the implementation may be included in at least one implementation or example. Such terms as used herein are not necessarily all referring to the same implementation. Any implementation may be combined with any other implementation, inclusively or exclusively, in any manner consistent with the aspects and implementations disclosed herein.

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of 'A' and 'B'" can include only 'A', only 'B', as well as both 'A' and 'B'. Such references used in conjunction with "comprising" or other open terminology can include additional items.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements.

Modifications of described elements and acts such as variations in sizes, dimensions, structures, shapes and proportions of the various elements, values of parameters, mounting arrangements, use of materials, colors, orientations can occur without materially departing from the teachings and advantages of the subject matter disclosed herein. For example, elements shown as integrally formed can be constructed of multiple parts or elements, the position of elements can be reversed or otherwise varied, and the nature or number of discrete elements or positions can be altered or varied. Other substitutions, modifications, changes and omissions can also be made in the design, operating conditions and arrangement of the disclosed elements and operations without departing from the scope of the present disclosure.

What is claimed is:

1. A glider to operate in an aqueous medium, comprising:

a fuselage in a shape of a body of revolution;

a ring wing lifting surface coupled to a stern of the fuselage;

a buoyancy engine disposed within the fuselage, the buoyancy engine configured to adjust a buoyancy and a center-of-gravity of the glider in the aqueous medium, to propel the glider through the aqueous medium by leveraging lift from the ring wing lifting surface;

an actuator coupled to a portion of the stern of the fuselage, the actuator configured to extend the ring wing lifting surface between a first position relative to the stern of the fuselage and a second position; and a pressure switch configured to:

detect an increase in pressure subsequent to the glider being launched in the aqueous medium; and unlock a spring, responsive to the increase in the pressure greater than a threshold, to cause the spring to extend the ring wing lifting surface between the first position and the second position.

2. The glider of claim 1, comprising:

the ring wing lifting surface coupled to the stern, configured to pivot the ring wing lifting surface along a vertical axis to steer the glider through the aqueous medium.

3. The glider of claim 1, comprising:

the ring wing lifting surface coupled to the stern, configured to pivot the ring wing lifting surface along a horizontal axis to adjust an ascent or descent of the glider through the aqueous medium.

4. The glider of claim 1, wherein a ratio of a diameter of the ring wing lifting surface to a length of the ring wing lifting surface is greater than or equal to 1.

5. The glider of claim 1, wherein the buoyancy engine comprises:

a pump configured to capture or release a fluid from a compartment within the fuselage to adjust the buoyancy of the glider.

6. The glider of claim 1, comprising:

one or more sensors configured to detect one or more characteristics of the aqueous medium or effects of an external stimuli on the aqueous medium.

7. The glider of claim 1, comprising:

a power source to deliver power to the buoyancy engine to adjust the buoyancy of the glider in the aqueous medium.

8. The glider of claim 1, wherein the ring wing lifting surface comprises an airfoil shaped element.

9. The glider of claim 1, wherein the glider lacks a wing separate from the ring wing lifting surface, and lacks a propeller.

10. The glider of claim 1, wherein the glider is loaded into a tube of a launch container.

11. The glider of claim 1, comprising:

a data processing system comprising one or more processors, coupled with memory, to:

receive a glide angle of the glider;

receive a velocity of the glider;

determine, based on the glide angle and the velocity, a control command to control a position of the ring wing lifting surface to increase the velocity of the glider; and operate the actuator to rotate the ring wing lifting surface to the position based on the control command.

12. A system, comprising:

a launch container, disposed on a marine vessel, to store at least one glider, wherein each of the at least one glider comprises:

a fuselage in a shape of a body of revolution;

a ring wing lifting surface coupled to a stern of the fuselage; and a buoyancy engine disposed within the fuselage, the buoyancy engine configured to adjust a buoyancy and a center-of-gravity of the fuselage in an aqueous medium to propel the fuselage through the aqueous medium by leveraging lift from the ring wing lifting surface; and one or more processors, coupled with memory, to deploy the at least one glider from the launch container into the aqueous medium.

13. The system of claim 12, wherein each of the at least one glider comprises:

an actuator coupled to a portion of the stern of the fuselage, the actuator configured to extend the ring wing lifting surface between a first position relative to the stern of the fuselage and a second position responsive to deployment from the launch container into the aqueous medium.

14. The system of claim 13, wherein each of the at least one glider comprises:

a pressure switch configured to:

detect an increase in pressure subsequent to deployment into the aqueous medium from the launch container; and unlock a spring, responsive to the increase in the pressure greater than a threshold, to cause the spring to extend the ring wing lifting surface between the first position and the second position.

15. The system of claim 12, wherein each of the at least one glider comprises:

one or more sensors configured to detect one or more characteristics of the aqueous medium or effects of an external stimuli on the aqueous medium.

16. The system of claim 12, wherein the launch container comprises a plurality of tubes to store the at least one glider.

17. A method, comprising:

deploying a glider in an aqueous medium, the glider comprising a fuselage in a shape of a body of revolution and a ring wing lifting surface coupled to a stern of the fuselage;

adjusting, by a buoyancy engine disposed within the fuselage, a buoyancy and a center-of-gravity of the glider in the aqueous medium to propel the glider through the aqueous medium by leveraging lift from the ring wing lifting surface;

receiving, by a data processing system of the glider comprising one or more processors, coupled with memory, a glide angle of the glider;

receiving, by the data processing system, a velocity of the glider;

determining, by the data processing system, based on the glide angle and the velocity, a control command to control a position of the ring wing lifting surface to increase the velocity of the glider; and operating, by the data processing system, an actuator to rotate the ring wing lifting surface to the position based on the control command.

18. The method of claim 17, comprising:

pivoting the ring wing lifting surface to steer the glider through the aqueous medium.

19. The method of claim 17, comprising:

detecting, by a pressure switch of the glider, an increase in pressure subsequent to the glider being launched in the aqueous medium; and unlocking, by the pressure switch, a spring, responsive to the increase in the pressure greater than a threshold, to cause the spring to extend the ring wing lifting surface between a first position and a second position.

20. The system of claim 12, comprising:

the at least one glider, comprising:

a pressure switch configured to:

detect an increase in pressure subsequent to the at least one glider being launched in the aqueous medium; and unlock a spring, responsive to the increase in the pressure greater than a threshold, to cause the spring to extend the ring wing lifting surface between a first position and a second position.

* * * * *